US007770395B2

(12) United States Patent
Tanimura et al.

(10) Patent No.: US 7,770,395 B2
(45) Date of Patent: Aug. 10, 2010

(54) COMBUSTOR

(75) Inventors: Satoshi Tanimura, Hyogo-ken (JP); Kenta Kurihara, Hyogo-ken (JP); Toshihiko Saitoh, Hyogo-ken (JP); Jose Rodriguez, Miami, FL (US)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 467 days.

(21) Appl. No.: 11/362,527

(22) Filed: Feb. 27, 2006

(65) Prior Publication Data

US 2007/0199325 A1 Aug. 30, 2007

(51) Int. Cl.
*F23R 3/20* (2006.01)
*F23R 3/04* (2006.01)

(52) U.S. Cl. ..... 60/737; 60/747; 60/760

(58) Field of Classification Search ..... 60/737, 60/746, 747, 748, 760
See application file for complete search history.

(56) References Cited

U.S. PATENT DOCUMENTS 4,297,842 A 11/1981 Gerhold et al.
5,134,855 A 8/1992 Belcher et al.
5,274,991 A * 1/1994 Fitts ..... 60/737
6,594,999 B2 * 7/2003 Mandai et al. ..... 60/760
6,634,175 B1 10/2003 Kawata et al.
6,688,107 B2 2/2004 Ono et al.
6,923,001 B2 * 8/2005 Laster et al. ..... 60/723
2001/0020364 A1 * 9/2001 Sato et al. ..... 60/746

FOREIGN PATENT DOCUMENTS

CA 2 340 107 A1 12/2000
JP 2000-346361 A 12/2000

* cited by examiner

*Primary Examiner*—Ted Kim
(74) *Attorney, Agent, or Firm*—Westerman, Hattori, Daniels & Adrian, LLP

(57) ABSTRACT

A sleeve 2*e* having the length of the side surface thereof made longer at a position away from the compressor outlet 11 is connected to the upstream-side end of an external cylinder 2*c*. By this sleeve 2*e*, compressed air flowing along the inside wall surface of a casing 4 flows, making a turn, in a space between the sleeve 2*e* and the inside wall surface of the casing 4, thereby providing the compressed air flow being introduced from the sleeve 2*e* to the external cylinder 2*c* with uniformity.

4 Claims, 10 Drawing Sheets

COMBUSTOR

BACKGROUND OF THE INVENTION

1. Field of the Invention

The present invention relates to a gas turbine combustor, and especially, relates to a combustor which is so constructed as to reduce drift and disturbance of airflow flowing through the interior thereof.

2. Description of the Prior Art

A cross-sectional view of FIG. 11 shows a general construction of a gas turbine. As shown in FIG. 11, a gas turbine comprises a compressor 1 compressing the air; combustors 2 being supplied with the air compressed by the compressor 1 and fuels so as to perform combustion; and a turbine 3 being rotary driven by combustion gas from the combustors 2. The compressor 1, the combustors 2 and the turbine 3 are covered by casings 4, respectively. In addition, a plurality of the combustors 2, sixteen pieces for example, are arranged on the outer circumference of a rotor 5 serving as one shaft sharing the compressor 1 and the turbine 3, being equally spaced.

In a gas turbine as described hereinabove, the air compressed by the compressor 1 is supplied to the combustors 2 and the rotor 5 through the interior of the casing 4. Then, the compressed air being supplied to the combustors 2 are used for combustion of fuels being supplied to the combustors 2. In addition, the compressed air being supplied to the interior of the casing 4 and the rotor 5 of the turbine 3 is used for cooling stationary vanes 31 fixed to the casing 4 and rotating blades 32 fixed to the rotor 5 both of which are exposed to high temperature due to combustion gas.

A combustor 2 being provided to such a gas turbine as constructed hereinabove comprises a combustor basket 2*a* being provided to the fuel-supply side; a transition piece 2*b* being connected to the combustor basket 2*a* and injecting combustion gas to the stationary vanes 31 in a first row of the turbine 3; and an external cylinder 2*c* being inserted so as to be along the inner wall of the casing 4 and covering the combustion basket 2*a*. Moreover, FIG. 12 shows an enlarged cross-sectional view depicting the vicinity of the combustor 2 in order to describe a detailed construction of the vicinity of the combustor 2.

As shown in FIG. 12, the combustor 2 has a combustor basket 2*a* comprise a pilot nozzle 21 being provided to the center thereof and performing diffusion combustion; a plurality of main nozzles 22 being provided to the outer circumference of the pilot nozzle 21, equally spaced, and performing premixed combustion; a pilot cone 23 being provided so as to cover the downstream-side tip of the pilot nozzle 21; and main burners 24 being provided so as to cover the downstream-side tips of the main nozzles 22. In addition, the compressor 1 is provided with a compressor outlet 11 for supplying the compressed air to the interior of the casing 4 where the combustor 2 is inserted, and the compressed air discharged from the compressor outlet 11 is supplied to the interior of the combustor basket 2*a*.

Moreover, in order to describe the detailed construction of a combustor 2, FIG. 13 shows an enlarged cross-sectional view of a combustor basket 2*a* of a combustor 2. As shown in FIG. 13, a combustor 2 comprises a pilot swirl 25 being installed so as to be in contact with the outer circumference of the pilot nozzle 21 on the upstream side inside the pilot cone 23 and main swirls 26 being installed so as to be in contact with the outer circumference of the main nozzles 22 on the upstream side inside the main burners 24. As a result, the air being supplied to the pilot cone 23 is made uniform in the pilot swirl 25 and at the same time, the air being supplied to the main burners 24 is made uniform in the main swirls 26.

Additionally, the combustor 2 has a plurality of supports 27 provided to the outer circumference of the combustor basket 2*a* on the upstream side thereof and a rib 29 provided to support a punched metal plate 28 consisting of a perforated plate being provided to the entrance to a space between the external cylinder 2*c* and the combustor basket 2*a* on the downstream side. By having the support 27 and the rib 29 connected to the external cylinder 2*c* and the combustor basket 2*a*, the combustor basket 2*a* is supported and fixed to the external cylinder 2*c*. Furthermore, on the downstream side of the pilot nozzle 21, the main nozzles 22 are fixed by having supports 30 provided to connect the outer circumference of the pilot nozzle 21 to the main nozzles 22.

For a combustor 2 being constructed as described hereinabove, the compressed air being discharged from the compressor outlet 11 to the interior of the casing 4 flows into a space formed between the external cylinder 2*c* and the combustor basket 2*a* by way of the punched metal plate 28. The punched metal plate 28 plays a role of uniformizing the compressed air flowing into the combustor 2 by being made of a perforated plate so as to provide resistance. The compressed air flowing into the space between the external cylinder 2*c* and the combustor basket 2*a* by way of the punched metal plate 28 flows along the inner wall of the external cylinder 2*c*.

In consequence, by having the compressed air make 180 degrees turn at the bottom part of the external cylinder 2*c* (the bases of the pilot nozzle 21 and the main nozzles 22), the compressed air flows in between the supports 27 supporting the combustor basket 2*a* and is supplied to the interior of the combustor basket 2*a*. Then, finally, a swirling flow is supplied by the pilot swirl 25 and the main swirls 26 of the combustor 2 so as to be used for diffusion combustion by the pilot nozzle 21 and used for premixed combustion by the main nozzles 22.

However, as shown in FIG. 13, the relative distance from each position of inlet of the compressed air being formed between the external cylinder 2*c* and the combustor baskets 2*a* to the compressor outlet 11 differs. Therefore, the flow volume of the compressed air being supplied to the combustor 2 becomes non-uniform at each position of inlet of the compressed air being formed between the external cylinder 2*c* and the combustor basket 2*a*. In consequence, the compressed air inside the combustor basket 2 flows unstably, which leads to unstable combustion thereof. In the end, not only NOx generation rate is increased but also such issue as deterioration of durability due to generation of combustion oscillations and the like occurs.

Therefore, the present applicant proposes a combustor which restrains flow disturbance and drift of the compressed air inside the combustor basket 2*a* by having a flow ring being formed to have a semicircle configuration and a ring shape installed to the position so as to be connected to the supports 27 and the combustor basket 2*a*. (See the Japanese Patent Application Laid-Open No. 2000-346361.) In the Japanese Patent Application Laid-Open No. 2000-346361, it is disclosed that the compressor outlet 11 is provided with a flow guide which directs the flow of the compressed air being discharged from the compressor outlet 11 so as to be supplied to the interior of the combustor 2 in a uniform flow.

By installing a flow guide as described hereinabove, compressed air flow is formed so as to be directed toward the combustor being installed outside the compressor outlet 11, thereby providing the flow volume of the compressed air being supplied to the combustor 2 with uniformity. However, because a passageway between each position of the compressed air inlets being formed between the external cylinder 2*c* and the combustor basket 2*a* and the compressor outlet 11 is different from each other, the easiness of the compressed air flow differs, depending on the passageway. As a result, the compressed air flow being supplied to the inside of the combustor basket 2*a* is made to be a non-uniform flow. In addition, because the flow along the inside wall of the casing 4 being more outside of the combustor 2 dominates mostly, non-uniformity thereof is increased.

SUMMARY OF THE INVENTION

It is an object of the present invention to provide a combustor which supplies the air to the inside thereof so as to flow in a uniform manner.

A combustor in accordance with the present invention comprises:

a pilot nozzle being provided to the center of axis of the combustor and performing diffusion combustion:

main nozzles being provided circumferentially, equally spaced, on the side of the outside-circumference of the pilot nozzle and performing premixed combustion;

a combustor basket covering the sides of the outside circumferences of the pilot nozzle and the main nozzles;

an external cylinder being provided to the side of the outside circumference of the combustor basket and serving as a passageway of compressed air between inside wall thereof and outside wall of the combustor basket; and a cylinder-type sleeve being provided with a side surface in a tapered shape which is connected to the end serving as the inlet side of the compressed air of the external cylinder;

wherein the length of the side surface of the sleeve changes in a manner that the longer the distance to the compressed air outlet discharging the compressed air is, the longer the length of the side surface of the sleeve is, while the shorter the distance to the compressed air outlet discharging the compressed air is, the shorter the length of the side surface of the sleeve is.

In accordance with the present invention, by making the length of the side surface of the sleeve provided to the end of the external cylinder have a long length on the side where the distance to the compressed air outlet is long, the compressed air flowing along the inside wall of the casing being installed to the combustor can be turned to the side where the distance to the compressed air outlet is short. To be specific, by having the compressed air flowing along the inside wall of the casing turn around in a space between the inside wall of the casing and the outside of the sleeve, it is possible to increase the volume of the compressed air being supplied to the side where the distance to the compressed air outlet of the sleeve is near. In consequence, the compressed air flow being supplied from the sleeve to the inside of the external cylinder can be made uniform, thereby stabilizing combustion in the combustor.

DESCRIPTION OF THE PREFERRED EMBODIMENTS

Figure 1:
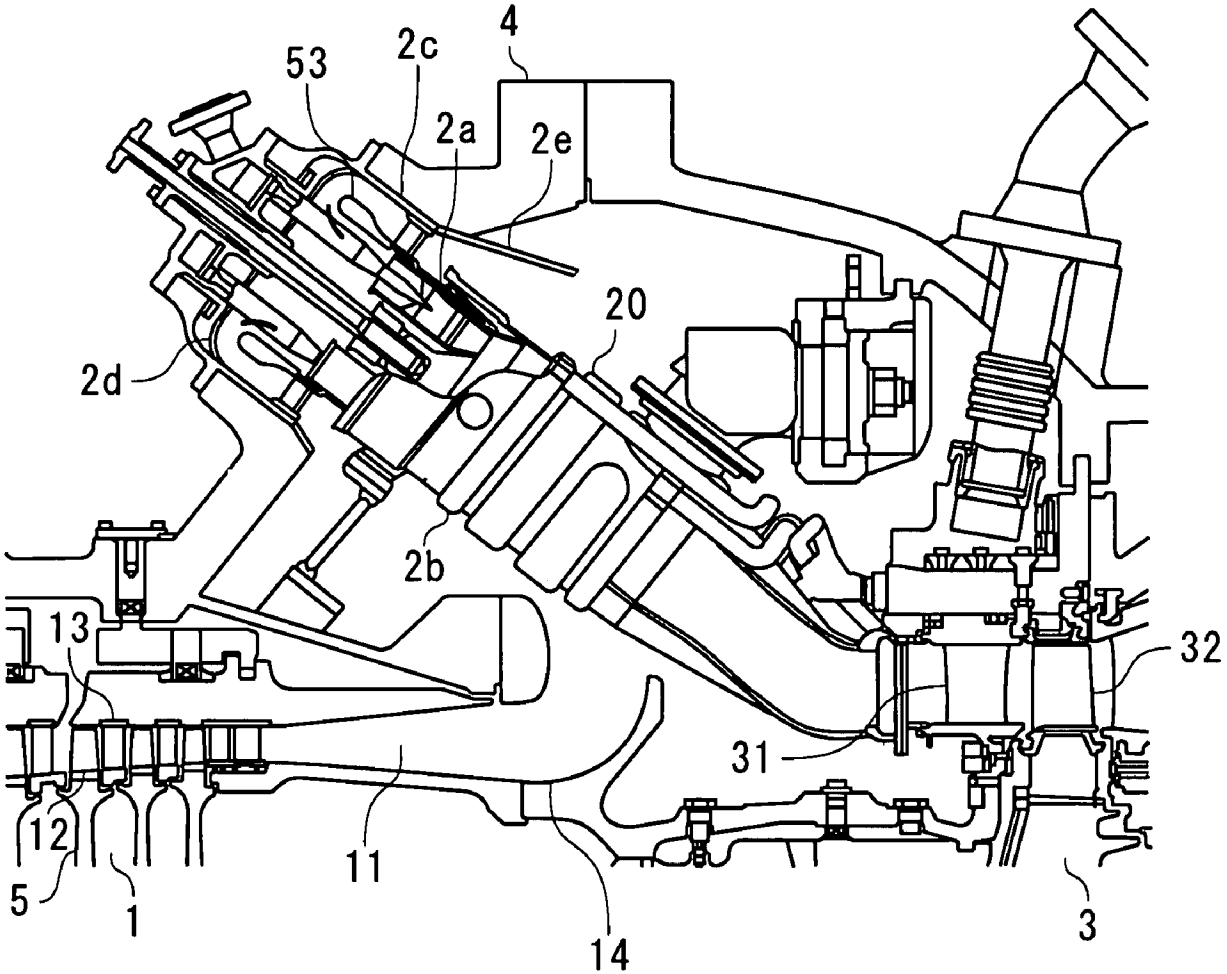
FIG. 1 is a cross-sectional view showing a construction of a surrounding area of a combustor in accordance with an embodiment of the prevent invention.
Figure 2:
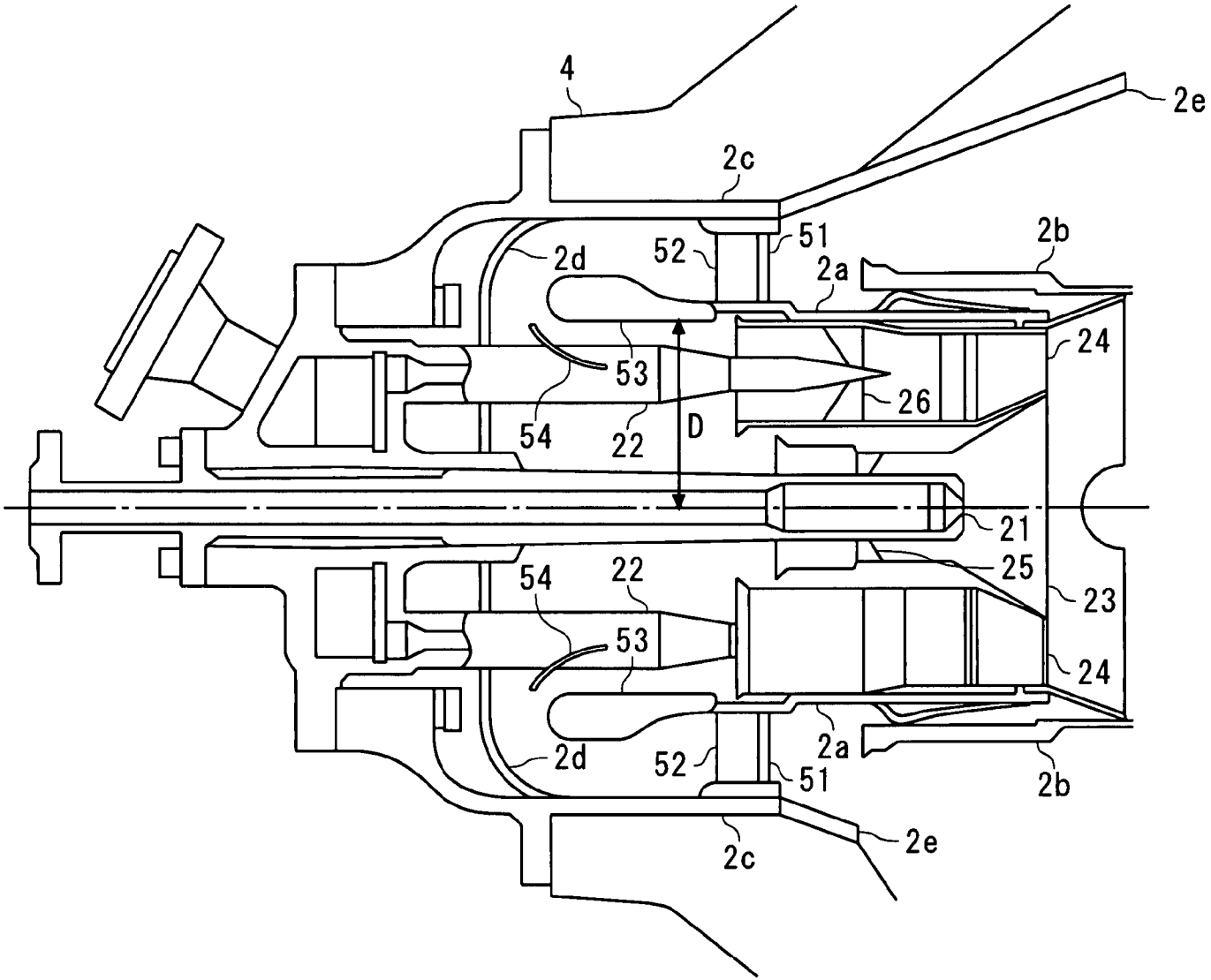
FIG. 2 is a cross-sectional view showing a construction of an inside of a combustor basket of a combustor of FIG. 1.

Referring now to the drawings, an embodiment of the present invention will be described hereinafter. FIG. 1 is a schematic cross-sectional view showing a construction of an inside of a combustor chamber where a combustor is inserted. FIG. 2 is a schematic cross-sectional view showing a construction of an inside of a combustor basket of a combustor of FIG. 1. In the construction of each portion, same symbols will be supplied to portions that are used for same purpose as portions shown in FIG. 12 and FIG. 13, and detailed explanation thereof will be omitted. In addition, the side of a transition piece inside a combustor basket will be referred as "downstream side," while the side of a transition piece in a space between an external cylinder and a combustor basket will be referred as "upstream side."

As shown in FIG. 1, inside a combustor chamber consisting of a casing 4, a plurality of combustors 20 being inserted therein from the outside are arranged on the outside circumference of a rotor 5, equally spaced. As shown in FIG. 2, same as a combustor 2 of FIG. 12, the combustor 20 comprises a pilot nozzle 21 being provided to a center thereof and performing diffusion combustion; a plurality of main nozzles 22 being provided circumferentially to the outside circumference of the pilot nozzle 21, equally spaced, and performing premixed combustion; a pilot cone being provided so as to cover the tip of the pilot nozzle 21; main burners 24 being provided so as to cover the tips of the main nozzles 22; a pilot swirl 25 being installed between the outside wall of the pilot nozzle 21 and the inside wall of the pilot cone 23; and main swirls 26 being provided between the outside walls of the main nozzles 22 and the inside walls of the main burners 24.

Then, as shown in FIG. 1 and FIG. 2, the combustor 20 comprises a combustor basket 2*a* being formed so as to cover the pilot nozzle 21 and the main nozzles 22; a transition piece 2*b* being engaged to the combustor basket 2*a* and introducing combustion gas from the pilot nozzle 21 and the main nozzles 22 to the gas turbine 3; an external cylinder 2*c* covering the outside circumference of the combustor basket 2*a* and at the same time being in contact with the inside wall of the casing 4; a back surface wall 2*d* closing the downstream of the external cylinder 2*c*; and a sleeve 2*e* serving as a cylinder having a tapered configuration so as to spread from the upstream-side end of the external cylinder 2*c* toward the combustor chamber.

In addition, the combustor 20 is provided with a punched metal plate 51 being a perforated plate in a ring shape, covering the upstream side of the external cylinder 2*c* in a space between the combustor basket 2*a* and the external cylinder 2*c*; a rib 52 supporting the punched metal plate 51 and being connected to the combustor basket 2*a* and the external cylinder 2*c*; a cylinder 53 being connected to the upstream side of the combustor basket 2*a* and having a bell-mouth construction being provided with a bulb formed toward the external cylinder 2*c*; and turning vanes 54 in a ring shape being installed in the vicinity of the upstream-side end of the cylinder 53 so as to cover the spaces between the main nozzles 22.

In a combustor 20 being constructed as described hereinabove, a plurality of main burners 24 are connected circumferentially to the downstream-side of the inside wall of the combustor basket 2*a*, being equally spaced, and a pilot cone 23 is installed to the center of the combustor basket 2*a* so as to have a close contact with each of the main burners 24. As a result, the pilot cone 23 and the main burners 24 are fixed to the downstream side of the combustor basket 2*a*. On the contrary, a cylinder 53 is connected to the upstream-side tip of the combustor basket 2*a* in a manner that an inside wall of the cylinder 53 is formed to be a same wall surface as the inside wall of the combustor basket 2*a* at the upstream-side end of the combustor basket 2*a*, thereby fixing a cylinder 53.

Then, a punched metal 51 is connected to the outside wall of the combustor basket 2*a* and the inside wall of the external cylinder 2*c* so as to cover the upstream-side of the external cylinder 2*c*, and a plurality of ribs 52 fixing the punched metal 51 are provided circumferentially, equally spaced. By having the ribs 52 connected to the outside wall of the combustor basket 2*a* and the inside wall of the external cylinder 2*c*, the combustor basket 2*a* is fixed to the inside of the external cylinder 2*c*. In addition, a pilot nozzle 21 is inserted into the center of the back surface wall 2*d* and main nozzles 22 are inserted circumferentially around the pilot nozzle 21, equally spaced. Then, by having a turning vane 54 connected to two adjacent main nozzles 22, turning vanes 54 are installed circumferentially to the spaces between the main nozzles 22. The back surface wall 2*d* where the pilot nozzle 21 and the main nozzles 22 are inserted is installed from the upstream-side of the external cylinder 2*c*.

By having the back surface wall 2*d* engaged to the external cylinder 2*c* and fixed as described hereinabove, the upstream sides of the pilot nozzle 21 and the main nozzles 22 are supported by the back surface wall 2*d* so that the pilot nozzle 21 and the main nozzles 22 are inserted into the inside of the combustor basket 2*a*, respectively. In addition, in order that the outside wall at the downstream-side tip of the pilot nozzle 21 is in close contact with the inside wall of the pilot swirl 25 of the pilot cone 23, the pilot nozzle 21 is inserted into the pilot swirl 25, which supports the downstream side of the pilot nozzle 21. In the same manner, in order that the outside wall at the downstream-side tips of the main nozzles 22 are in close contact with the inside walls of the main swirls 26, the main nozzles 22 are inserted into the main swirls 26, which support the downstream-side tips of the main nozzles 22.

Then, portions where the combustor basket 2*a*, the external cylinder 2*c* and the back surface wall 2*d* are connected, respectively, are inserted into a casing 4 forming a combustor chamber so as to be fixed. Inside the combustor chamber, the combustor basket 2*a* being inserted into is inserted into the transition piece 2*b*, thereby forming a combustor 20. Wherein, inside the combustor chamber, a sleeve 2*e* is provided in a manner that the sleeve 2*e* surrounds a hole in the casing 4 where the combustor 20 is inserted, and the portions being constructed by the combustor basket 2*a*, the external cylinder 2*c* and the back surface wall 2*d* are inserted into the sleeve 2*e*. As a result, in the combustor 20 being installed inside the combustor chamber, the sleeve 2*e* is connected and fixed to the upstream-side end of the external cylinder 2*c*.

In addition, as shown in FIG. 1, a compressor 1 comprises rotating blades 12 being installed to the rotor 5 and stationary vanes 13 being installed to the casing 4, and by having the rotor 5 rotated by rotation of the turbine 3 so as to make the rotating blades 12 and the stationary vanes 13 work, thereby having the air from the outside compressed. Then, the compressed air being obtained by the compressor 1 is discharged from a compressor outlet 11 of the compressor 1 to the combustor chamber. At the downstream-side end of the compressor outlet 11, a flow guide 14 is provided which guides the compressed air being discharged from the compressor outlet 11 to flow toward the sleeve 2*e* in the combustor 20 inside the combustor chamber. In consequence, when the compressed air being compressed by the compressor 1 is discharged from the compressor outlet 11, the compressed air flows toward the sleeve 2*e* being provided to the proximity of a portion where the combustor 20 is inserted, by being guided to the side of the inside wall of the casing 4 by the flow guide 14.

(Construction of the Sleeve and the Flow Guide)

Figure 3A:
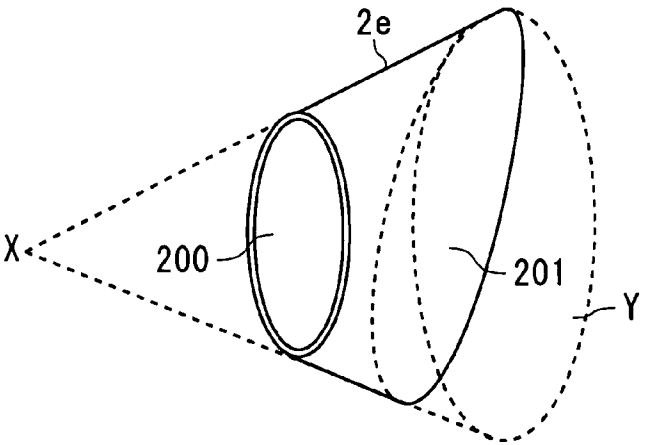
FIG. 3A is a schematic perspective view showing a construction of a sleeve of a combustor of FIG. 2.

The construction of a sleeve 2*e* being provided to the combustor 20 fixed inside the combustor chamber by the casing 4 and the construction of a flow guide being provided to the compressor outlet 11 of the compressor 1 will be described hereinafter. First, as shown in a perspective view of FIG. 3A, the shape of the sleeve 2*e* is formed in a manner that a cone indicated with dotted lines is cut so as to have the side of the tip "X" thereof be in parallel with the bottom surface "Y" as well as is cut diagonally so as to have the side of the bottom surface "Y" intersect with the bottom surface "Y." To be specific, in the sleeve 2*e*, an end surface 200 on the side of the tip "X" having a small area is parallel with the bottom surface "Y," and the end surface 201 on the side of the bottom surface "Y" having a larger area becomes a surface forming an angle with the bottom surface "Y."

Figure 3B:
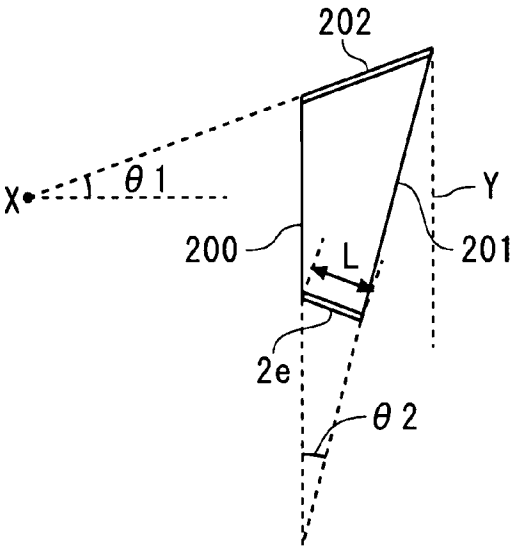
FIG. 3B is a schematic cross-sectional view showing a construction of a sleeve of a combustor of FIG. 2.

In addition, as shown in a cross-sectional view of FIG. 3B, in the sleeve 2*e*, an angle "θ1" of the side surface 202 to an axis connecting the center of the bottom surface "Y" and the tip "X," an angle "θ2" being formed by the end surface 200 and the end surface 201 and the length "L" of a portion where the length is shortest on the side surface 202 are specified to be optimum values in order that the compressed air flowing into the sleeve 2*e* is made uniform. For example, by having the angles "θ1" and "θ2" and the length "L" be as such "θ1" is 20 degrees, "θ2" is 15 degrees and "L" is 100 mm, the compressed air flow can be made uniform. As shown in FIG. 1, the sleeve 2*e* having the value of each portion specified as described hereinabove is provided to a position where the side surface having the shortest length comes to the nearest position to the rotor 5. Wherein, the end surface 200 having a small area is connected to the upstream-side end of the external cylinder 2*c*.

To be specific, the portion of the side surface 202 where the length thereof is shortest shares the same surface with the inside wall surface of the casing 4, and the sleeve 2*e* is provided in a manner that the other portion of the side surface 202 excluding the portion where the length is shortest protrudes from the inside wall surface of the casing 4 to the inside of the combustor chamber. In addition, in the sleeve 2*e*, a space is formed between the side surface protruding from the inside wall surface of the casing 4 and the inside wall surface of the casing 4 by specifying the angle "θ1" of the side surface 202 to the axis to be an optimum value.

Figure 4:
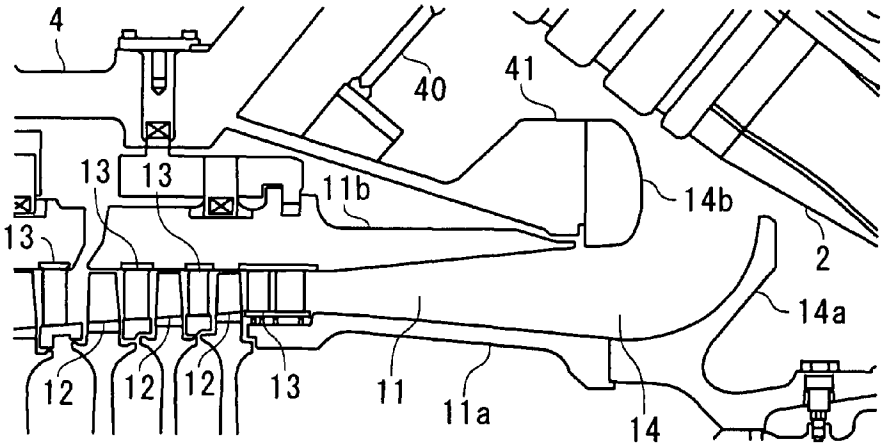
FIG. 4 is a cross-sectional view showing a construction of a compressor outlet in a compressor of FIG. 1.

Additionally, a flow guide 14 is formed to be a duplex cylinder and provided to the outside circumference of the rotor 5 at the end of the compressed air outlet being constructed in a duplex cylindrical configuration. To be specific, as shown in FIG. 4, the flow guide 14 comprises an inside ring 14*a* having an inside ring 11*a* at the compressor outlet 11 extend to the combustor chamber side and an outside ring 14*b* having an outside ring 11*b* at the compressor outlet 11 extend to the combustor chamber side. Wherein, the inside ring 14*b* is connected to a protruding portion 41 where a supporting member 40 of the combustor 2 is installed in the casing 4, while the outside ring 14*b* is formed so as to be a part of an intermediate shaft connecting the compressor 1 to the turbine 3 so as to share one shaft.

Then, the inside ring 14*b* of the flow guide 14 has a curved surface bending from the rotor 5 toward the inside wall of the casing 4 provided on the combustor chamber side in the direction from the compressor outlet 11 to the combustor chamber. In addition, the outside ring 14*b* has a curved surface bending from the rotor 5 to the inside wall of the casing 4 in the direction from the compressor outlet 11 to the combustor chamber. In such a manner as described hereinabove, by having the inside rig 14*a* and the outside ring 14*b* of the flow guide 14 provided with a surface curving and bending toward the inside wall side of the casing 4, respectively, the compressed air can be guided to the opening side of the sleeve 2*e* of the combustor 20.

Figure 5:
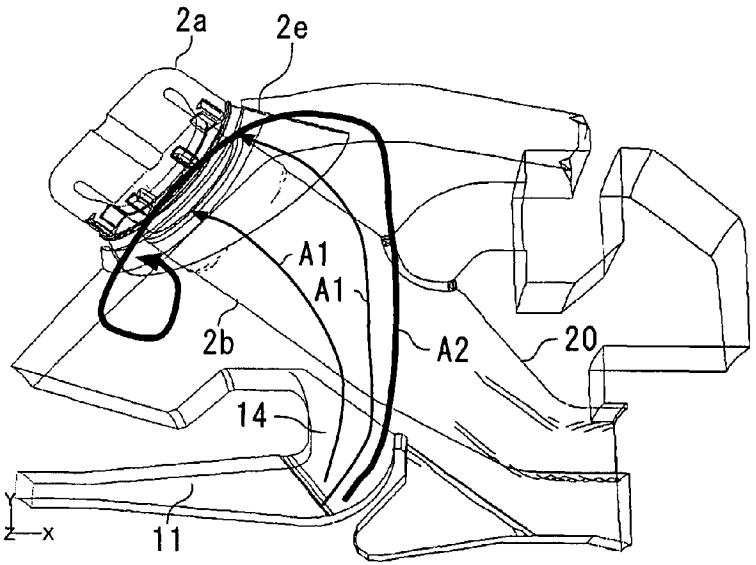
FIG. 5 is a diagram showing a compressed air flow inside a combustor chamber of FIG. 1.

By providing such a sleeve 2*e* and a flow guide 14 as described hereinabove, the compressed air being compressed by the compressor 1 flows inside the combustor chamber flows as shown with arrow marks in a schematic diagram of FIG. 5. To be specific, due to curving and bending of the flow guide 14, the compressed air is guided more toward the side of the outer circumference than the rotor 5, which forms a compressed air flow (Arrow "A1") flowing toward the sleeve 2*e* of the combustor 20.

At this time, as shown with an arrow "A2," the compressed air flowing along the inside wall of the casing 4 which is more on the side of the outside circumference than the combustor 20 flows into a space between the side of the outside circumference of the sleeve 2*e* and the inside wall of the casing 4. Then, as shown with an arrow "A2," the compressed air flowing into the space between the side of the outside circumference of the sleeve 2*e* and the inside wall of the casing 4 flows along the side of the outside circumference of the sleeve 2*e* and goes around to the sleeve 2*e* on the side of the rotor 5 thereof, thereby flowing into the inside of the sleeve 2*e* from the sleeve 2*e* on the side of the rotor 5 thereof.

Consequently, the compressed air flow flowing into a space between the sleeve 2*e* and the transition piece 2*b* can be made uniform, so that the compressed air flow flowing between the external cylinder 2*c* and the combustor basket 2*a* can be uniformized circumferentially on the outside circumference of the combustor basket 2*a*. As a result, the compressed air flow flowing into the inside of the combustor basket 2*a* can be made uniform, thereby stabilizing combustion of the pilot nozzle 21 and the main nozzles 22 being provided to the combustor 20, respectively.

(Construction of the Back Surface Wall, Cylinder and Turning Vanes)

Figure 6:
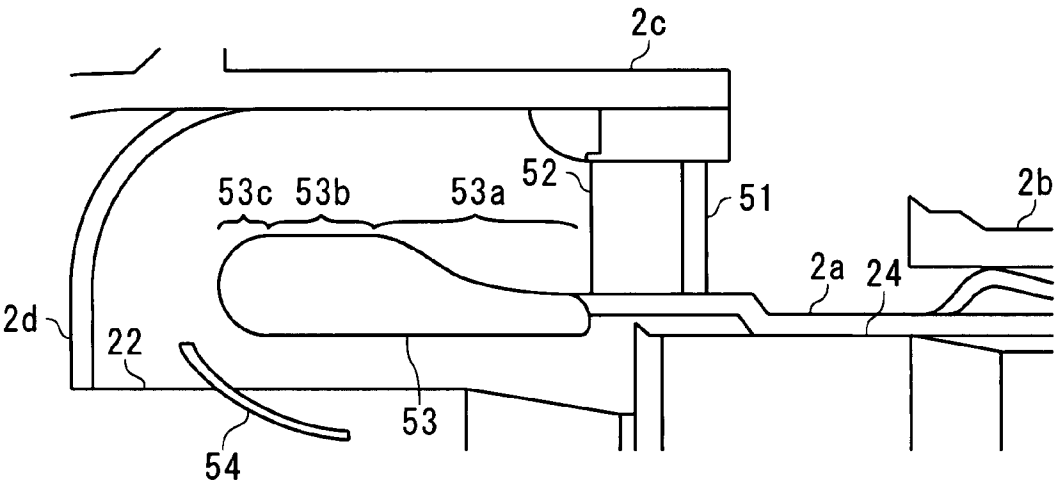
FIG. 6 is a cross-sectional view showing a construction of a cylinder of a combustor of FIG. 1.

Now, the construction of the back surface walls 2*d*, the cylinders 53 and turning vanes 54 of a combustor 20 in FIG. 2 will be described hereafter. As described above, the construction is a bell-mouth construction that the outside-wall side of the cylinder 53 is upcurved toward the external cylinder 2*c*. As shown in a cross-sectional view of FIG. 6, the cylinder 53 having the bell-mouth construction is provided with a tapered portion 53*a* where the distance to the inside wall of the external cylinder 2*c* from the upstream-side tip thereof to the downstream-side thereof becomes shorter; a flat portion 53*b* where the distance to the inside wall of the external cylinder 2*c* on the downstream side of the tapered portion 53*a* is uniform; and a semi-circular portion 53*c* where the downstream-side end has a cross section in approximately semicircle configuration. In addition, the portion where inclination on the upstream side of the tapered portion 53*a* starts and the portion where the tapered portion 53*a* and the flat portion 53*b* are connected to each other are shaped so as to be smoothly rounded.

By having the cylinder 53 constructed as described hereinabove, the outside wall of the cylinder 53 is constructed so as to come close to the inside wall of the external cylinder 2*c* toward the downstream side. Therefore, a cross-sectional area of a passageway of compressed air being formed between the inside wall of the external cylinder 2*c* and the outside wall of the cylinder 53 is gently narrowed. As a result, the compressed air flow is throttled and uniformity in the circumferential direction of a combustor against the downstream-side flow of the cylinder 53 is achieved. In addition, by having the tapered portion 53*a* of the cylinder 53 formed so as to be gently upcurved like a bulb, the compressed air flowing through the punched metal plate 51 can be prevented from separation.

Figure 7:
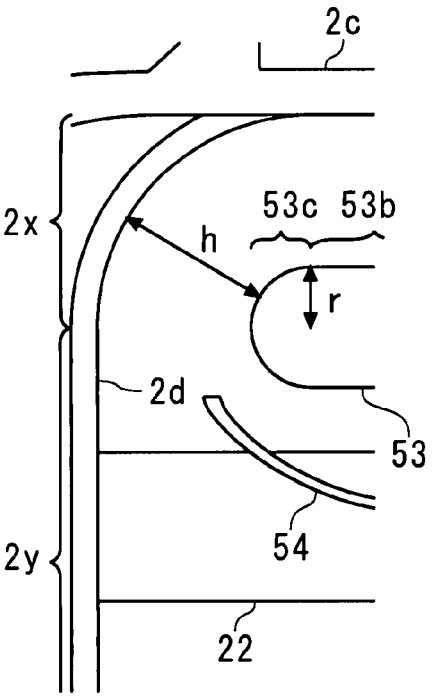
FIG. 7 is a cross-sectional view showing a construction of a back surface wall of a combustor of FIG. 1.

Additionally, as shown in the cross-sectional view in FIG. 7, the back surface wall 2*d* is constructed in such a manner as the side of the outside circumference of the cylinder 53 being a curved surface serves as an arc-shaped portion 2*x*, and the side of the inside circumference of the cylinder 53 being flat serves as a flat portion 2*y*, thereby making the inside wall surface thereof be a concave surface having a mortar shape. Wherein, the curvature of the arc-shaped portion 2*x* corresponds to the curvature of the outside circumference of the semicircle-shaped portion 53*c* of the cylinder 53, and the distance between the inside wall surface of the arc-shaped portion 2*x* of the back surface wall 2*d* and the outside wall surface of the semicircle-shaped portion 53*c* of the cylinder 53 becomes constant. In addition, the connected portion of the arc-shaped portion 2*x* to the flat portion 2*y* in the back surface wall 2*d* is formed on an axial extension line from the downstream-side end of the semicircle-shaped portion 53*c* of the cylinder 53.

By having the back surface wall 2*d* constructed as mentioned hereinabove, it is possible to make the cross-sectional area being made by the inside wall surface of the arc-shaped portion 2*x* of the back surface wall 2*d* and the outside wall surface of the semicircle-shaped portion 53*c* of the cylinder 53 be equal to a cross-sectional area being formed by the inside wall of the external cylinder 2*c* and the flat portion 53*b* of the cylinder 53, thereby being constant. By this, the compressed air flowing between the outside wall of the cylinder 53 and the inside wall of the external cylinder 2*c* can be introduced to the inside of the cylinder 53 uniformly, and the compressed air flow can be made to turn 180 degrees stably on the back surface wall 2*d*. In addition, the distance "h" between the inside wall of the arc-shaped portion 2*x* of the back surface wall 2*d* and the outside wall of the semicircle-shaped portion 53*c* of the cylinder 53 (See FIG. 7.) and the radius "r" of the semicircle-shaped portion 53*c* of the cylinder 53 (See FIG. 7.) are specified in a manner that pressure loss coefficient "ζ" becomes small in the relation of the pressure loss coefficient "ζ" versus the inside diameter "D" of the combustor basket 2*a* and the cylinder 53 (See FIG. 2.).

Figure 8:
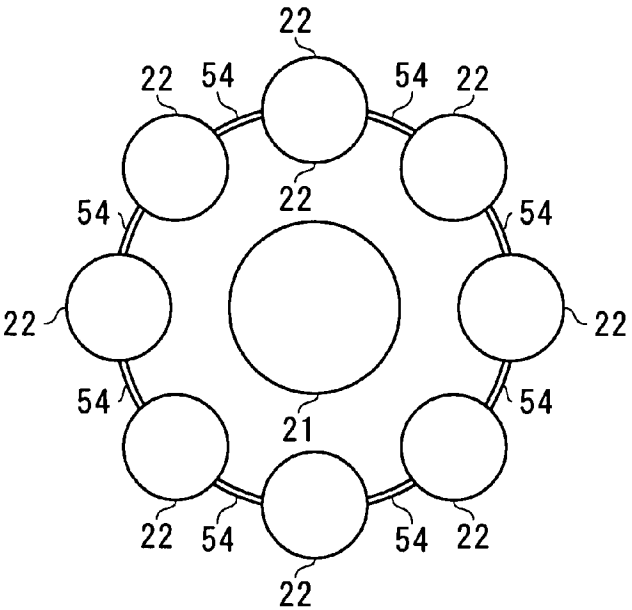
FIG. 8 is a cross-sectional view showing a relation between turning vanes and main nozzles of a combustor of FIG. 1.

Additionally, a turning vane 54 is made of a piece of plate which is bent from the outside circumference of the main nozzle 22 to the position of the axis of the main nozzle 22, in case of being viewed from the more upstream side than the cylinder 53 toward the downstream side. Then the turning vane 54 is formed so as to have the curvature thereof be equivalent to the curvature of the inside wall of the semi-circle-shaped portion 53*c* of the cylinder 53. Moreover, as shown in FIG. 8, a turning vane 54 is an arc-shaped plate connecting the side surfaces of the main nozzles 22. By such turning vanes 54 constructed as described hereinabove, the compressed air being made to turn 180 degrees on the back surface wall 2*d* is introduced to the pilot cone 23 and the main burners 24. Then, by having the turning vanes 54 serve as single vanes, pressure resistance can be restrained and the compressed air can flow in a uniform manner.

By having each of the back surface wall 2*d*, the cylinder 53 and the turning vanes 54 constructed as described hereinabove, the compressed air flowing into a space between the external cylinder 2*c* and the cylinder 53 is made uniform at the tapered portion 53*a* of the cylinder 53 and subsequently, is made to turn 180 degrees at the back surface wall 2*d*, maintaining uniform flow. Then, the compressed air being made to make a turn at the back surface wall 2*d*, flowing uniformly, is uniformized by the turning vanes 54 and then introduced to the pilot cone 23 and the main burners 24. In addition, because it is possible to maintain the compressed air flow being introduced to the pilot cone 23 and the main burners 24 to be uniform, the distances from the upstream-side end of the cylinder 53 to the pilot cone 23 and the main burners 24 can be shortened, compared with a conventional construction.

(Construction of a Punched Metal Plate and Ribs)

Figure 9A:
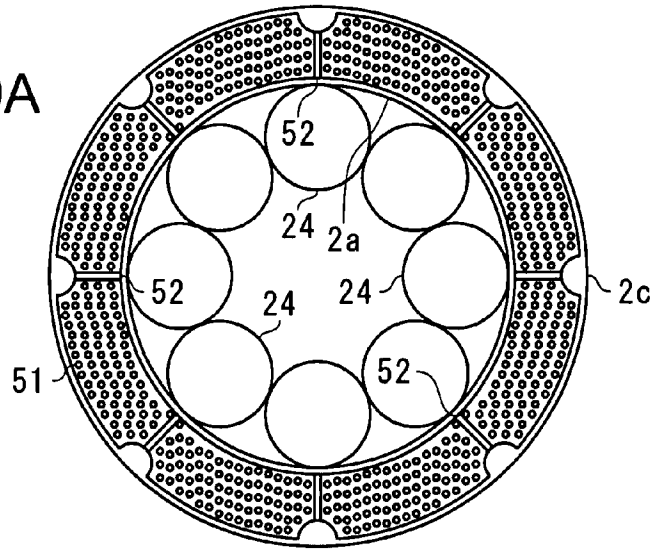
FIG. 9A is a front view of the external cylinder of a combustor of FIG. 1, viewed from the downstream side.

Construction of a punched metal plate 51 and ribs 52 of a combustor shown in FIG. 2 will be described hereinafter. As shown in the front view of an external cylinder 2*c* seen from the downstream side thereof in FIG. 9A, a punched metal plate 51 is constructed so as to be in a ring shape covering the entrance of the passageway of the compressed air between the outside wall of the combustor basket 2*a* and the inside wall of the external cylinder 2*c* and at the same time is constructed to be a perforated plate having a plurality of holes. Then, as shown in the front view of FIG. 9A, ribs 52 are provided in a radial pattern against the axis of a combustor in a manner that both ends of a rib 52 are in contact with the outside wall of the combustor basket 2*a* and the inside wall of the external cylinder 2*c*. Additionally, ribs 52 are provided in a plural number, and the plurality of ribs 52 are arranged so as to be equally spaced in the circumferential direction of a combustor and connected to the external cylinder 2*c*, thereby supporting the combustor basket 2*a*.

Figure 9B:
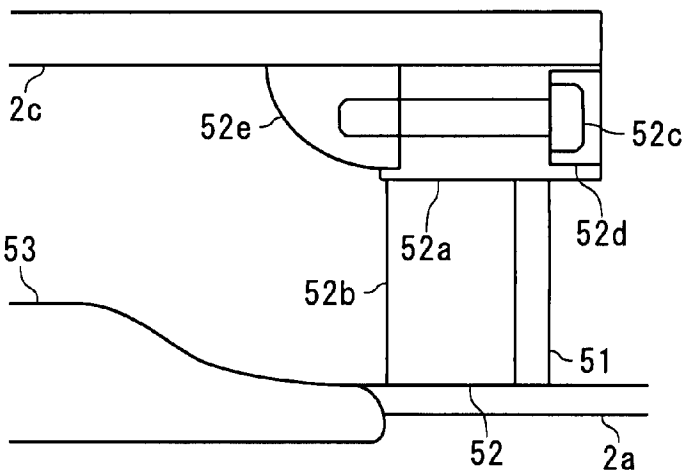
FIG. 9B is a cross-sectional view showing a surrounding area of a rib of a combustor of FIG. 1.

Moreover, as shown in a cross-sectional view of FIG. 9B, a rib 52 is provided with a fixing member 52*a* being connected to the outside-circumference side of a punched metal plate 51 and a plate member 52*b* being formed so as to protrude from the fixing member 52*a* to the combustor basket 2*a*, being in contact with the combustor basket 2*a*. Then, the fixing member 52*a* is constructed so as to be formed in a columnar configuration having a semicircle-shaped cross section and to be provided with a through screw hole inside thereof where a bolt 52*c* is inserted. The upstream side of the fixing member 52*a* is provided with a concave portion 52*d* where the head portion of the bolt 52*c* is embedded, and after the bolt 52*c* is inserted therein, the concave portion 52*d* is filled with a metal part, thereby forming a flat end surface.

In addition, as shown in a cross-sectional view of FIG. 9B, the external cylinder 2*c* has the inside wall thereof equipped with a rib-connecting member 52*e* which is connected to the fixing member 52*a* of a rib 52 and is formed so as to have the axial direction be approximately columnar. The rib-connecting member 52*e* is provided with a screw hole where a bolt 52*c* is inserted. As a result, a bolt 52*c* going through the screw hole of the fixing member 52*a* is inserted into the screw hole of the rib-connecting member 52*e*, which fixes the fixing member 52*a* to the rib-connecting member 52*e*, thereby, in consequence, fixing the punched metal plate 51 and the rib 52 to the external cylinder 2*c*. Moreover, by having the downstream-side end surface of the rib-connecting member 52*e* formed to be approximately semicircle curved surface, the compressed air can be prevented from being supplied with disturbance as much as possible.

By installing the ribs 52 fixed to the external cylinder 2*c* in a radial pattern as described hereinabove, the combustor basket 2*a* is pressed toward the center thereof by the ribs 52 so as to be fixed by the ribs 52. As a result, the downstream-side tips of the main nozzles 22 can be supported by the main swirls 26 in the main burners 24 being connected to the combustor basket 2*a*. Therefore, the aforementioned construction made by the back surface wall 2*d*, the cylinder 53 and the turning vanes 54, the compressed air flowing in the combustor basket 2*a* can be made uniform, which can shorten the axial lengths of the pilot nozzle 21 and the main nozzles 22. Consequently, supports being connected to the pilot nozzle 21 for supporting the downstream side of the main nozzles 22 will become unnecessary. Furthermore, by having the compressed air made uniform, resistance due to the punched metal plate 51 can be decreased, compared with the conventional construction, thereby restraining the pressure loss at the punched metal plate 51.

Figure 10:
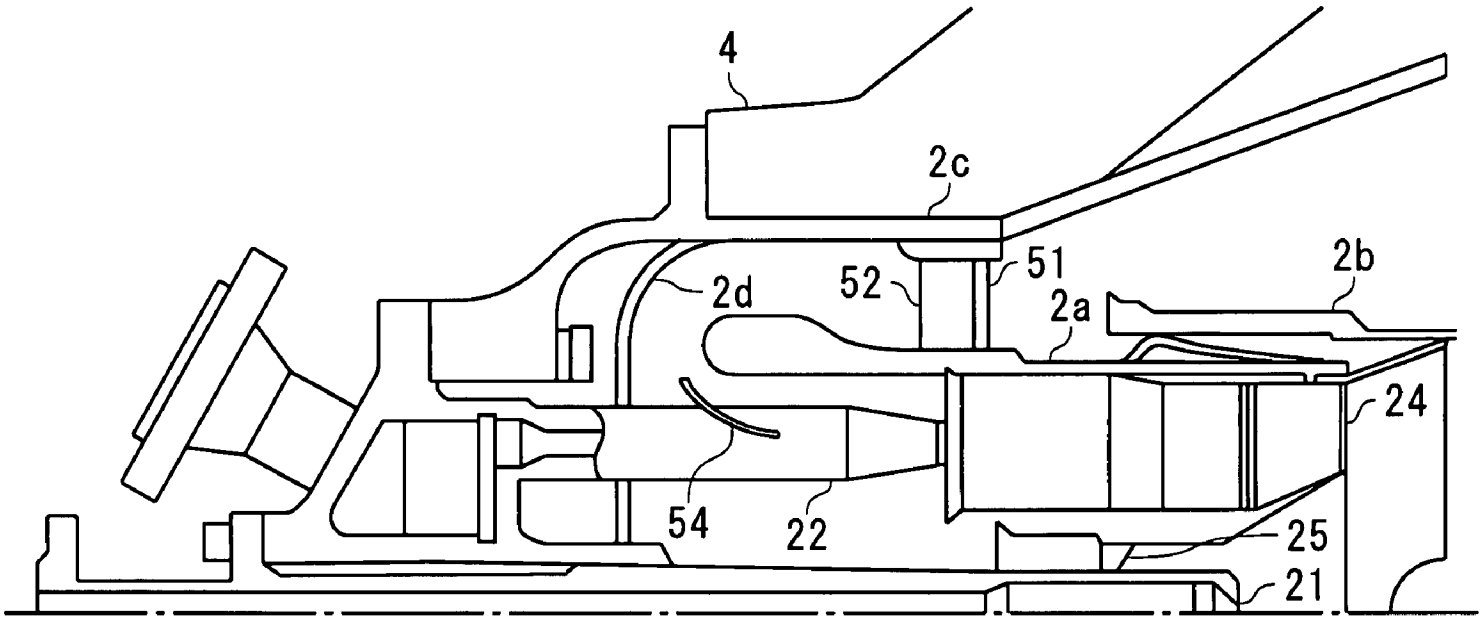
FIG. 10 is a cross-sectional view showing a construction of a combustor when a cylinder and a combustor basket are united.
Figure 11:
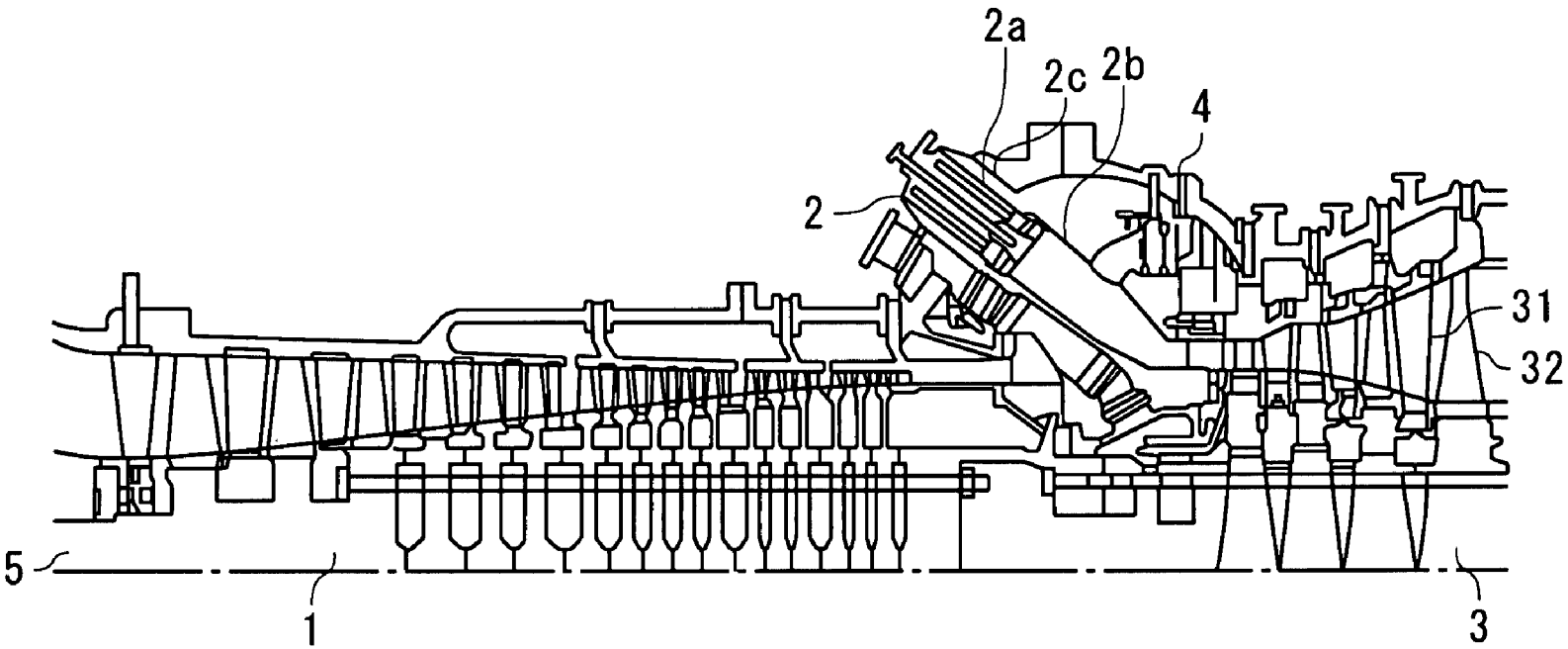
FIG. 11 is a schematic cross-sectional view showing a construction of a general gas turbine.
Figure 12:
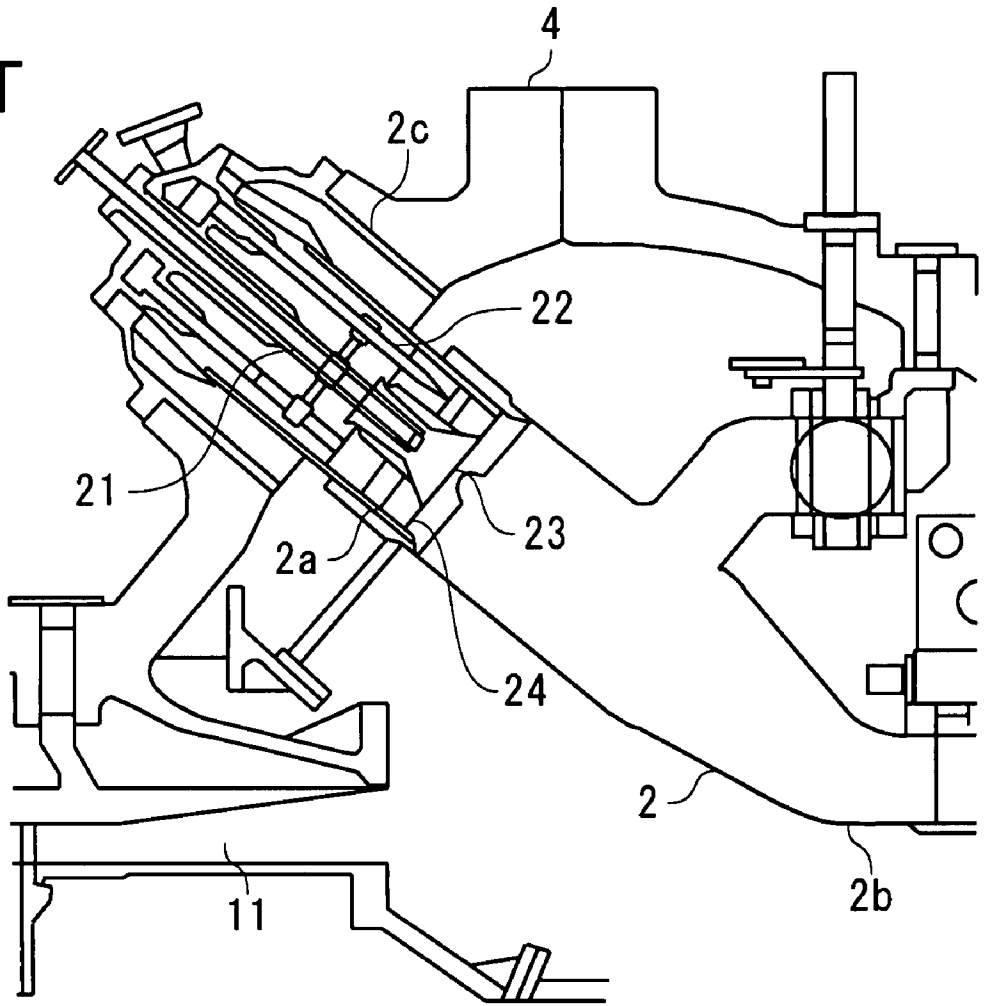
FIG.12 PRIOR ART
FIG. 12 is an enlarged cross-sectional view of a combustor of a conventional gas turbine.
Figure 13:
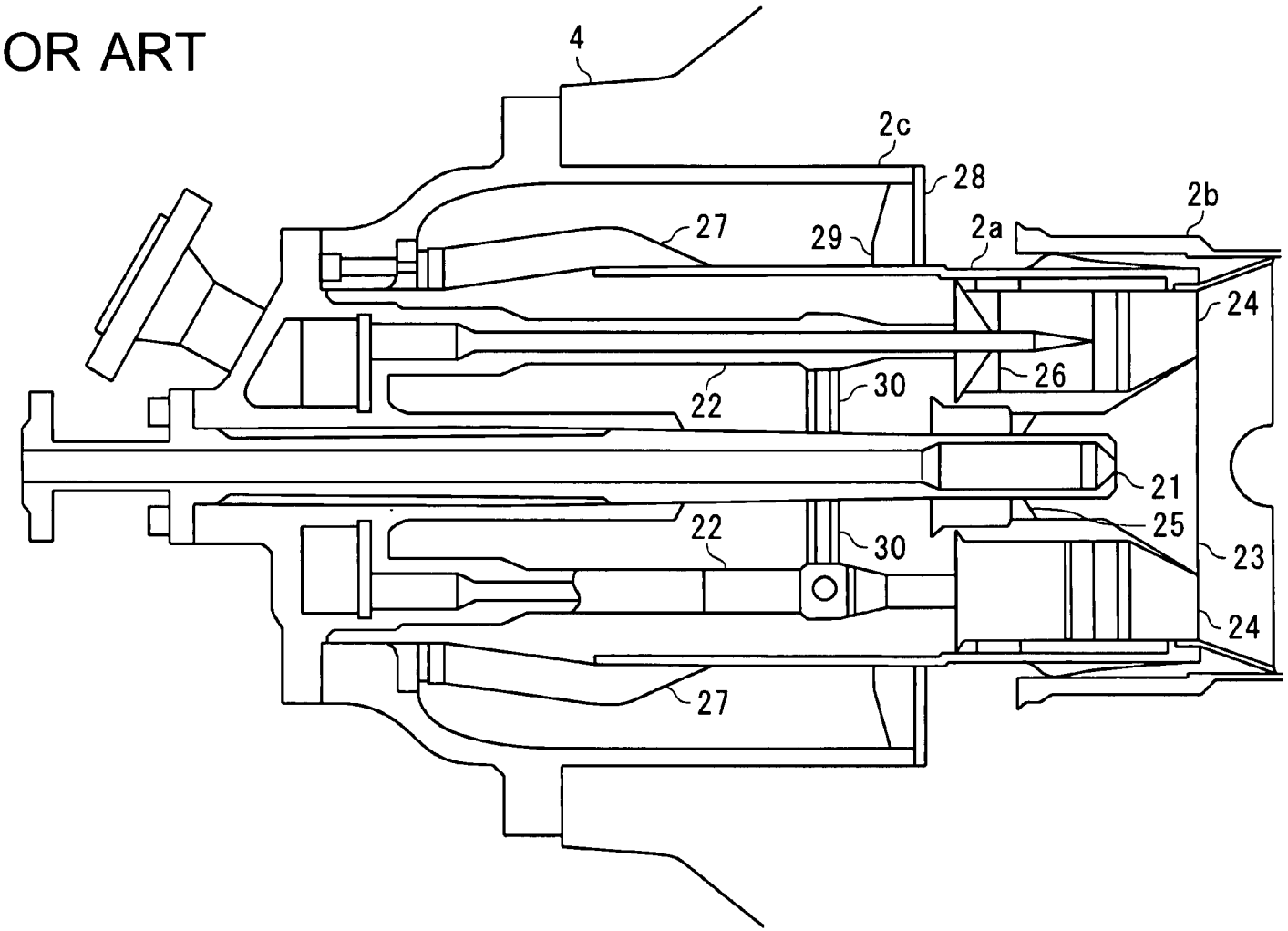
FIG.13 PRIOR ART
FIG. 13 is an enlarged cross-sectional view of a combustor basket of a combustor of a conventional gas turbine.

In addition, in the present embodiment, a combustor 20 having a construction shown in FIG. 2 has been explained as an example of a combustor 20. However, a combustor having another construction is acceptable as long as a combustor is constructed in a manner the upstream-side end of the external cylinder 2*c* is provided with a sleeve 2*e* being shaped as shown in FIG. 3. Therefore, for example, in addition to the construction being the same as conventional as shown in FIG. 12 or a construction being disclosed in the Japanese Patent Laid-Open No. 2000-34361, a sleeve 2*e* may further be provided. In addition, in the present embodiment, the cylinder 53 serves as a different component from the combustor basket 2*a*. However, as shown in FIG. 10, the upstream-side end of the combustor basket 2*a* may be constructed so as to have such a bell-mouth construction as the cylinder 53 has.

What is claimed is:

1. A combustor comprising:

a pilot nozzle provided at a center of an axis of the combustor, and performing diffusion combustion;

main nozzles provided circumferentially around the pilot nozzle so as to be equally spaced with each other, and performing premixed combustion;

a combustor basket covering outside circumferences of the pilot nozzle and the main nozzles;

an external cylinder provided around an outside circumference of the combustor basket so as to form a passageway of a compressed air between an inside wall thereof and an outside wall of the combustor basket; and a cylinder-type sleeve provided with a side wall having a first end and formed in a tapered shape which is connected to a distal end serving as an inlet of the compressed air of the external cylinder, wherein a length of the side wall of the sleeve changes in a manner that the longer a distance to a compressed air outlet which discharges the compressed air is, the longer a length of the side wall of the sleeve is, while the shorter a distance to the compressed air outlet is, the shorter a length of the side wall of the sleeve is, and wherein an open space is formed between an external surface of the side wall of the sleeve and a casing of a gas turbine, the sleeve first end being spaced from the casing.

2. The combustor according to claim 1, wherein the sleeve has a shape of a frustum which has a bottom surface diagonally intersecting with an axis thereof.

3. The combustor according to claim 1, wherein when the combustor is installed in the casing of the gas turbine, the sleeve protrudes from an inside wall surface of the casing to an inside of a chamber of the casing, so as to have a length of protrusion of the sleeve is longer on a side where a distance to the compressed air outlet is far.

4. The combustor according to claim 1, wherein the compressed air outlet is provided with a flow guide bending toward the combustor.

* * * * *